US006092952A

United States Patent [19]

Eberle

[11] Patent Number: 6,092,952

[45] Date of Patent: Jul. 25, 2000

[54] BOTTLE MOUNTED APPLICATOR FOR AUTOMOTIVE DETAILING

[76] Inventor: Jim J. Eberle, 14750 Memorial Dr., Houston, Tex. 77079

[21] Appl. No.: 09/120,480

[22] Filed: Jul. 22, 1998

[51] Int. Cl.[7] ..... B43K 5/02

[52] U.S. Cl. ..... 401/146; 401/139; 401/203; 239/329

[58] Field of Search ..... 401/146, 150, 401/190, 207, 139, 205, 203, 204; D23/225; 222/324, 383.1; 239/333, 329

[56] References Cited

U.S. PATENT DOCUMENTS

| | | | |
|---|---|---|---|
| D. 376,697 | 12/1996 | Green et al. | 401/207 X |
| 2,496,033 | 1/1950 | Berry | 401/203 |
| 2,760,587 | 5/1956 | Spier et al. | 22/180 |
| 2,897,526 | 8/1959 | Dootson | 401/190 X |
| 3,164,856 | 1/1965 | Samaras et al. | 401/190 |
| 4,705,191 | 11/1987 | Itzel et al. | 222/80 |
| 4,922,859 | 5/1990 | Durell et al. | 401/146 X |
| 5,088,849 | 2/1992 | Johnson et al. | 401/150 X |
| 5,279,450 | 1/1994 | Witt, Jr. | 222/324 X |
| 5,299,877 | 4/1994 | Birden | 401/207 X |
| 5,421,483 | 6/1995 | Parise | 222/383.1 X |
| 5,597,255 | 1/1997 | Yager et al. | 401/207 |
| 5,643,403 | 7/1997 | Poole et al. | 401/207 X |
| 5,885,019 | 3/1999 | Stear | 401/139 |

FOREIGN PATENT DOCUMENTS

| | | | |
|---|---|---|---|
| 118664 | 1/1927 | Switzerland | 401/205 |

*Primary Examiner*—David J. Walczak
*Attorney, Agent, or Firm*—Gunn & Associates, P.C.

[57] ABSTRACT

An applicator bottle which includes a hand grip neck, a trigger mounted for index finger operation of a pump, and the pump delivers liquid from the bottle. An important feature includes an upwardly canted backing plate having a sponge where in the angle of canting is about twenty to thirty degrees.

20 Claims, 1 Drawing Sheet

FIG. 1
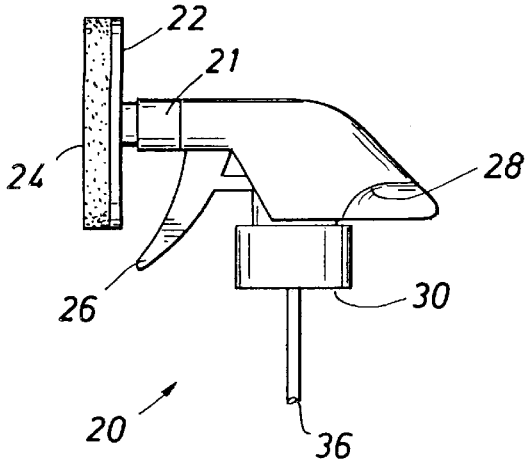
FIG. 2
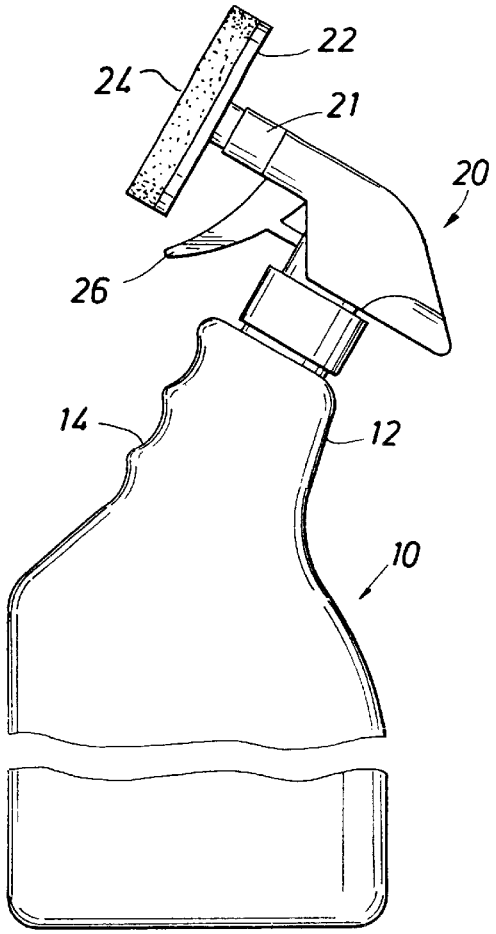
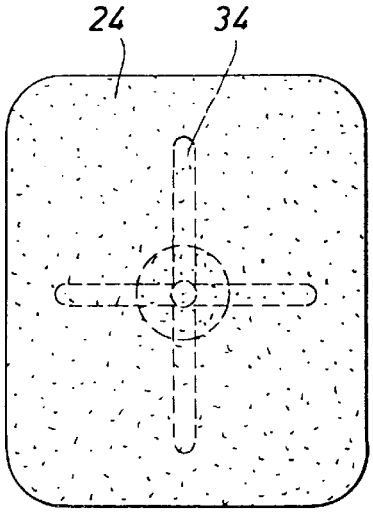
FIG. 3
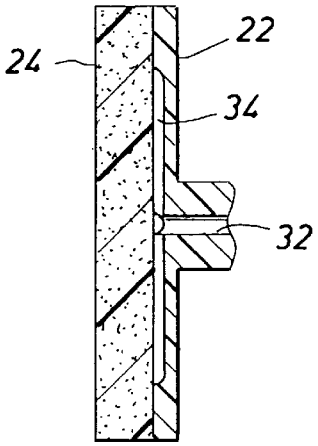
FIG. 4

BOTTLE MOUNTED APPLICATOR FOR AUTOMOTIVE DETAILING

BACKGROUND OF THE DISCLOSURE

It is desirable to take care of the typical automobile. Even where the owner has complete disinterest in the matter, there are times and seasons at which care, and even more care has to be applied to the automobile. In the area of detailing, it is desirable to wash, clean and preserve the finish. Not only does this include treatment of the windows, chrome and painted body portions, this also covers the sidewalls of the tires. From a bumper mounted spare tire typified by a 1920 model with a rumble seat up to the present style vehicle, the sidewalls of the exposed tires are often scuffed and require periodic treatment. The treatment can be as casual as simply washing with running water, or using a sponge in a bucket with water and soap. The present disclosure is directed to a detailing device which enables care to be provided in a more enhanced and expedited manner. It reaches beyond merely washing away the road grime and dust that will accumulate on the sidewalls of the exposed tires. This disclosure sets out a system which can be used to clean, and actually clean with great facility. It reduces the number of utensils that are required, i.e., it furnishes a cleaning fluid but, it avoids the necessity for using a sponge and bucket. In the alternative, it avoids the use of a soaked rag. In another aspect, it avoids the use of other implements so that the net result is reduced time required to accomplish sidewall cleaning.

Sidewall cleaning can sometimes be described as "stoop labor". That is the general term applied to the painful chore of bending and leaning over to get something done. It is perhaps difficult enough for some people just to do that for 10 or 15 seconds. It is altogether a different chore to lean over or knell in a stooped position to clean the exposed sidewalls of four tires on an automobile. It is both awkward, tedious and painful. When stooping, it is hard to get full leverage of the strength of the person in the task or chore. Stooping to work on sidewalls is eased in this instance by freeing up one hand of the user.

Going specifically to the motions and movements required by the user, this device avoids the use of buckets, sponges, wiping rags, etc. Rather it provides a single device which is a large storage bottle which can be easily hand held and which is equipped with a head supporting a wiping sponge. The length of the head and hence the length of the sponge is selected so that it is equal to and slightly longer than the width of sidewalls on most passenger car tires. The head is constructed with an elongate stiff backing member which mounts a sponge like material on the surface. The head positions the backing at an elevated facing angle. As will be explained, the position of the head is turned upwardly somewhat so that the user, when stooping, can accomplish appropriate contact against the sidewall for wiping. Accordingly, one feature of the present apparatus is the incorporation of the attached stiff backing above a container having a hand grip and including a trigger or lever operated pump which delivers a stored fluid from the bottle to the stiff backing. There, the pumped liquid flows in a diffused and distributed manner through an open cell sponge, thereby enabling the head to be wiped directly against the target surface. In this instance, the target is the sidewall. Often it will be white sidewalls. In any event, this enables the hand grip of the bottle to serve as a hand grip also for the applicator. The user then does not need a separate bucket; no other accessories are needed at that juncture. This permits some lateral force to be applied using the bottle itself. Moreover a scrubbing action can be imparted. The hand grip can be readily grasped to enable the head to be applied against the sidewall. All of this is done with one hand, leaving the other hand free so that the user can steady his posture while scrubbing the sidewall. The free hand can be used to stabilize the position so that the user is not required to be busy with both hands dipping into and out of a bucket with a sponge, etc. Moreover the bottle held in the hand of the user can be swung in a circling motion as the circular sidewall is scrubbed.

During the circular motion of scrubbing, the index finger of the user can be conveniently put onto or off the pump lever so that the liquid is applied in timely fashion. This avoids waste of the liquid treatment. It helps keep the head and in particular the sponge on the face of the head moist for cleaning. Moreover this kind of motion and cleaning enables the user to treat the sidewall thereby accomplishing what is otherwise difficult hand labor with improved personal comfort and ease. Moreover the finished product (meaning the washed and clean sidewall) is accomplished with enhanced speed and reduced difficulty.

The apparatus of this disclosure is briefly summarized as including a relatively large storage bottle. The bottle holds typically between ten and twenty ounces of liquid. The bottle is equipped with the upper hand grip portion where the hand of the user will fit about the narrow reduced neck area where the hand grip portion is located. Curved notches are provided for a least two or three fingers of the user. The hand grip supports a trigger which is connected with a liquid pump. The pump delivers liquid from the bottle to the head. Of significance, the head is terminated with a transverse or perpendicular backing member. The head and the pump area are inclined upwardly at an inclined angle. This tilt positions the head not only above the bottle, but it also locates it at an angle so that facial contact of the head against the sidewall is accomplished without the bottle interfering with this position. The head is constructed with a sponge coextensive over the backing member, there by enabling a ready application of the pumped liquid of the head to be wicked through the sponge to ooze through the sponge for quick application. This has the advantage of steadily supplying a measured portion to the sidewall so that even application is obtained.

BRIEF DESCRIPTION OF THE DRAWINGS

So that the manner in which the above recited features, advantages and objects of the present invention are attained and can be understood in detail, a more particular description, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 shows the sidewall applicator head;

FIG. 2 shows the bottle mounted applicator head of this disclosure from the side;

FIG. 3 adds details of the applicator head; and

FIG. 4 is a sectional view of the applicator head.

DETAILED DESCRIPTION OF THE PREFERRED EMBODIMENTS

Attention is first directed to FIG. 1 of the drawings which shows the construction of the sidewall treatment apparatus at the present disclosure. The apparatus attaches to a bottle 10 which holds a specified quantity of liquid. While the bottle 10 can be made to any size, because of height and weight restrictions which will be noted below, it is typically constructed with something on the order of about ten to about twenty-four ounces of liquid in it. If it were made larger, it would become so heavy that it would be unwieldy. Also, as it becomes larger, it becomes taller and there is a reasonable limitation to the height of the bottle 10. This limitation is practical in the sense that it also makes the bottle more difficult to manufacture, fill, and ship. It also makes the bottle sufficiently tall that it may bump against the ground during use as will be elaborated below. If unreasonably small, the bottle may become relatively costly in contrast with the number of uses permitted by the bottle. In that sense, it would seem to be economically unattractive to the purchaser who realized only two or three uses out of the purchase. To that end, the bottle 10 carries perhaps twelve or sixteen ounces of the liquid stored on the bottle.

The bottle 10 is a closed structure. It is provided with a cap which is attached by threads. Typically, the cap 30 is affixed to the bottle itself by threads and the cap 30 supports the upstanding head portion to be described. In that instance, a head 20 comprising a pump 28 and other equipment above the cap 30 are easily attached or removed in the event that it desirable to refill the bottle. The bottle has an upstanding neck portion 12 which is equipped with a set of finger grips 14 for the hand of the operator. The grips 14 define an area at which the entire structure is held in the hand of the user. This permits the index finger to reach around a pump lever 26 component of the head 20. The pump lever is actuated on demand. This delivers a pumping motion from the pump lever 26 to the supported pump 28. The cap 30 supports a suction straw 36 long enough to reach to the bottom of the bottle. The head 20 supports the nozzle 21 as will be explained and the pump which is connected so that liquid is pumped from the inside of the bottle 10 to the head 20. The pump lever 26 operates like a trigger when reciprocating motion is applied to the lever. It is equipped with a return spring so that it can be pumped repetitively. When pumping liquid is delivered through the pump mechanism 28, it flows through the nozzle 21 to a back located support plate 22 which is adjacent to a sponge 24. More specifically, the back plate 22 is approximately rectangular as shown in FIG. 3. The width is typically about an inch, and can be as much as about two inches. Greater width can be implemented but it does not serve much added purpose to make it that large. Rather, the back plate 22 is simply an adequate width for support of the sponge 24. The back plate 22 is typically made with rounded corners. Indeed, plate 22 can be constructed as a relatively long oval. The back plate 22 generally is planar, and is constructed with reasonable thickness so that it lends structural integrity to the sponge 24. The sponge is applied to the head to the thickness of about one quarter inch or greater. The sponge is the wear member that ultimately engages in scrubbing contact and is worn away. More specifically, the sponge has a thickness of about one quarter to about three eighths inch. It is an open cell structure glued to the back plate 22. Sponge 24 is made of an open cell structure to enable liquid delivered into the sponge to flow in all directions through the sponge. The sponge is used to dissipate the liquid pumped into the sponge and distribute the liquid across the face of the sponge. The sponge itself has an exposed facial area which is brought into contact with the sidewall. The liquid pumped into the sponge flows through the sponge and comes against the face, thereby making the liquid available for sidewall cleaning. As shown, the liquid flows through the small passage 32 (see FIG. 4) and then to the lateral flow lines 34 in FIG. 3. The lines 34 connect radially outwardly.

One important feature this of disclosure is the relative angle of the plate 22 and the attached sponge 24 with respect to the upstanding bottle. It is desirable that it be tilted up at an angle. If the head were precisely vertical and hence parallel to the axis of the liquid bottle 10, it would then be required to extend some distance laterally to the side. It would have to extend at least that distance to be located beyond the hand of the user wrapped around the shaped pistol grip 14 on the head. That is acceptable but it is relatively unwieldy. It is unwieldy in the sense that it makes the head set off by such a distance that the bottle might tip readily from an upstanding position. It also makes the device more difficult to place in a shipping carton after manufacturing and filling. It also requires that the arm of the user be substantually at right angles to the tire, and that requires a good deal more stooping. The back plate 22 is canted upwardly. The optimum angle is a range of about twenty to thirty degrees. This enables the head 20 to be positioned more near the center line axis of the bottle 10. Also, it provides something of an improved repositioning so that the knuckles of the user are not easily exposed during application. Last of all, it makes the device somewhat more compact in that the lateral protrusion is reduced. With this canted angle, the user can then position his or her arm at an angle of about twenty to thirty degrees above the horizontal. That angular repositioning reduces the amount of stooping required in the operation. The canted head having an angle in the range of about twenty to about thirty degrees assures that this device when used in a commercial establishment for detailing automobiles can be used time and time again without unduly tiring the applicator. Thus, if a user during the day has to clean the sidewalls of a different vehicle every hour, the several occasions are handled with enhanced leverage to the applicator who is grasping the bottle at the grip and swinging the bottle in a circular motion as the head is scrubbed over the sidewalls of the several vehicles. This is less tiring and can be repeated time and time again through the work day.

The base of the bottle 10 has a specified length and width at the foot, known below as a foot print. If the foot print proportions are unduly narrow, the device would topple to the side. It would also topple however if the foot print area in contrast with the height of the bottle is disproportionate with the head extended horizontally off to the side. Bottle stability is enhanced by the incorporation of the canted head. Moreover, the tendency of the bottle to topple would vary depending on the amount of liquid in the bottle. For instance, the bottle when full will tend to be more stable because of the added weight. As the amount of liquid is reduced, the bottle then becomes lighter and the set off weight of the head becomes significantly greater. While the weight of the head does not change, the off centered construction and lack of vertical alignment will create a problem with stability. Effectively, canting or tilting the head seems to significantly improve the stability of the bottle. By constructing the head with a tilt so that the backing plate and the sponge attached to it is brought closer to the center line axis of the equipment, the structure is made more stable. The center of gravity of the structure is then moved so that it is more in line with the footprint of the bottle when resting on the ground. In general terms, the center of gravity is moved to a more desired location.

The tilted or canted neck positioning the head at a canted angle provides benefits when the bottle is full or empty or in-between. The construction just described has the advantage of easy head removal and refilling. If nothing else, the user can refill the bottle simply with soapy water. However, it is preferable that the device be made, shipped, and sold with specially selected solutions for sidewall cleaning. This is often called "dressing" which refers to more than soap and wash water; this includes the idea of smoothing scuffs and color restoration. Where the surface of the sidewall has been scuffed and scarred, there are suitable filler solutions available which dress the sidewall to restore it to original smoothness. Such solutions are believed to be well known. Separately, it is possible also to fill the bottle simply with a soap solution for the expressed purpose of scrubbing road grime and discoloration marks from the sidewall. In that sense, the sponge simply operates as a wash sponge. To that end, it may be necessary for the user to have two of these bottles available. The first can be filled with the detergent or other cleaning solution. After that has been applied and rinsed the second bottle can be used to apply a solution which smoothes the scuff marks so that the face of the sidewall is restored to a like new condition.

In FIG. 2 of the drawings, the bottle 10 has a non specific height. Care should be taken regarding the height of the bottle. As mentioned earlier, the volume of the bottle is dependent on the capacity of the bottle and that in turn is dependent on height. The height can be reduced; reduction significantly changes the relative proportions of the bottle. If the height is reduced, some other dimension is preferably increased so that the bottle is able to hold an adequate volume of liquid. The volume of liquid stored in the bottle is used in its operation. The height of the bottle becomes important in the swirling or circular motion that is applied to clean a sidewall. The bottle is kept as short as appropriate to avoid dragging on the ground. The height of the bottle is limited so that the applicator head (the exposed surface in FIG. 3) is applied to the sidewall without dragging the bottom tip of the bottle. That is a proportioning problem which is aided somewhat by shortening the height and by canting the head angle. There is a balance with the relative angle of the canted head 20 appended to the top of the bottle. FIG. 2 of the drawings is made free of scale or dimensions. As will be understood, the scale is varied depending on practical factors including the width of the sidewall, and the clearance of the sidewall above the ground or support surface. In the latter instance, it may be readily commonplace to simply position the vehicle on the ground where it is supported on the four tires. In some instances, the tires are elevated. The optimum is raise the vehicle relative to the user of the present invention so that the motion of cleaning and dressing the sidewalls is applied approximately above the knees of the user and extended slightly above the waist. Again, if the vehicle tires are on the ground and the user is swirling the dressing material applied to the sidewalls, that swirling action assures cleaning but it may be somewhat awkward when that low. As noted, the posture of the user is improved by the present device which has the canted head as shown in FIG. 2 of the drawings.

In summarizing the present invention, one important aspect is the absence of scale in the bottle height which is something of a trade off with the angle for the tilted head and other scale factors. FIG. 2 is therefore an illustration showing a significant range of height in the bottle. While the foregoing is directed to the preferred embodiment, the scope is determined by the claims which follow.

I claim:

1. An apparatus for dressing a sidewall, the apparatus comprising:

(a) a bottle adapted to be filled with a sidewall applied solution;

(b) a hand grip area on the bottle enabling the user to grab and hold the bottle at the hand grip;

(c) an applicator head connected to the bottle comprising
- (i) a pump,
- (ii) a nozzle through which said pump pumps said solution from said bottle,
- (iii) a back plate canted at an angle with respect to a center line axis of said bottle and
  - comprising a flow passage and lateral flow channels which are connected only at said flow passage and which extend radially from said flow passage, and
  - supporting a sponge applicator contacting said flow channels, and
  - attached to said nozzle so that said pumped solution passes through said flow passage and said lateral flow channels and diffuses into cells of said sponge applicator, and said back plate and said sponge applicator define a planar facial area for wiping contact with said sidewall; and (d) wherein said applicator head is canted upwardly at an angle enabling user application of the head while gripping the bottle at the hand grip and while permitting solution from the bottle to be applied to the sidewall.

2. The apparatus of claim 1 wherein:

(a) said applicator head is canted at an angle of about twenty to thirty degrees with respect to a plane perpendicular to said center line axis of said bottle;

(b) said angle is selected to align a center of gravity of said head with said center line axis; and (c) a length of said bottle measured along said center line axis is selected to cooperate with said angle so that said bottle will not drag the ground when cleaning said sidewall.

3. The apparatus of claim 2 wherein said applicator head comprises said back plate and said sponge of common length, and said back plate and sponge have an aggregate height corresponding to sidewall width.

4. The apparatus of claim 1 wherein said pump includes an index finger operated pump trigger for operating said pump.

5. The apparatus of claim 4 wherein said pump trigger operates said pump by drawing said solution from said bottle through a suction straw, where a first end of said straw connects to said pump and a second end of said straw a bottom of said bottle.

6. The apparatus of claim 5 wherein said pump delivers said solution under pressure through said flow passage and through said lateral flow channels within said back plate to flow into said sponge.

7. The apparatus of claim 6 wherein said sponge is contacted against said back plate to obtain said solution pumped from said bottle and to apply said solution to the sidewall.

8. The apparatus of claim 1 wherein said hand grip area terminates at a threaded connection for a cap and said cap supports said applicator head there above and said cap is removable for filling of the bottle with said solution.

9. The apparatus of claim 8 wherein said applicator head comprises a cap mounted structure above said cap and said hand grip is formed by shaped indentures and ridges in said bottle below said head.

10. The apparatus of claim 9 wherein said hand grip is formed in the bottle at the neck thereof.

11. The apparatus of claim 1 wherein said back plate is an elongate rectangle and said lateral flow channels comprise four flow channels at ninety degree angles on a face of said back plate contacting said sponge applicator thereby forming fluid flow passage to wet the sponge applicator with solution pumped from the bottle.

12. The apparatus of claim 11 wherein (a) said bottle comprises (i) a bottom and upstanding bottle portion enabling said bottle to stand upright, and (ii) a threaded circular neck ending on said bottle to enable attaching and removal of a bottle cap;

(b) said applicator head comprises an integral upstanding base for said applicator head which attaches to said bottle cap; and (c) wherein said base supports said applicator head at the desired canted position when said bottle cap is threaded on said bottle neck.

13. The apparatus of claim 12 wherein said bottle cap supports an elongate suction straw sucking solution from said bottle when said pump is operated.

14. The apparatus of claim 13 wherein said bottle stores up to about 20 ounces of solution.

15. The apparatus of claim 13 wherein said bottle has a specified footprint and said applicator head is over the footprint.

16. The apparatus of claim 12 wherein said applicator head is canted at an angle of about twenty degrees with respect to a plane perpendicular to a center line of said bottle.

17. The apparatus of claim 16 wherein said applicator head comprises said back plate and said sponge of common length, and said back plate and sponge have an aggregate height corresponding to sidewall width.

18. The apparatus of claim 17 wherein said applicator head includes an index finger operated pump lever for operating said pump.

19. The apparatus of claim 18 wherein said pump lever operates said pump by drawing said solution from said bottle through a suction straw, where a first end of said straw connects to said pump and a second end of said straw a bottom of said bottle.

20. The apparatus of claim 19 wherein said pump delivers solution under pressure through said flow passage and through said lateral flow channels within said back plate to flow into said sponge.

* * * * *